United States Patent [19]

Knaster et al.

[11] Patent Number: 4,717,431

[45] Date of Patent: Jan. 5, 1988

[54] NICKEL-FREE METAL PHOSPHATING COMPOSITION AND METHOD FOR USE

[75] Inventors: Mark B. Knaster, Ambler; William R. Skowronek, Jeffersonville, both of Pa.

[73] Assignee: Amchem Products, Inc., Ambler, Pa.

[21] Appl. No.: 18,885

[22] Filed: Feb. 25, 1987

[51] Int. Cl.[4] ..... C23C 22/08

[52] U.S. Cl. ..... 428/628; 148/6.15 R; 427/327; 428/469; 428/472.2

[58] Field of Search ..... 148/6.15 R, 6.15 Z, 148/31.5; 427/327

[56] References Cited

U.S. PATENT DOCUMENTS

| | | | |
|---|---|---|---|
| 2,121,574 | 6/1938 | Romig | 148/6.15 Z |
| 2,296,844 | 9/1942 | Glasson | 148/6.15 Z |
| 2,385,800 | 10/1945 | Dou | 148/6.15 Z |
| 2,398,529 | 4/1946 | Holmquist | 148/6.15 Z |
| 2,487,137 | 11/1949 | Hoover et al. | 148/6.15 Z |
| 2,540,314 | 2/1951 | Amundsen | 148/6.15 Z |
| 2,800,422 | 7/1957 | Piccinelli | 148/6.15 Z |
| 3,144,360 | 8/1964 | Palm | 148/61.5 Z |
| 3,240,633 | 3/1966 | Goureau et al. | 148/6.15 Z |
| 3,269,877 | 8/1966 | Schlossberg et al. | 148/6.15 Z |
| 3,459,600 | 8/1969 | Sedlak | 148/6.15 Z |

FOREIGN PATENT DOCUMENTS

| | | |
|---|---|---|
| 16259 | 6/1982 | Australia . |
| WO85/03089 | 7/1985 | PCT Int'l Appl. . |

OTHER PUBLICATIONS

Handbook of Chemistry & Physics, 66th ed. (1985), CRC Press, pp. D-151-D-158.

*Primary Examiner*—Thurman K. Page
*Assistant Examiner*—Leon R. Horne
*Attorney, Agent, or Firm*—Ernest G. Szoke; Henry E. Millson, Jr.; Mark A. Greenfield

[57] ABSTRACT

Nickel-free aqueous phosphating compositions containing zinc ions, cobalt ions, phosphate ions, and at least two additional cations; methods for using such composition, and products of the methods.

34 Claims, 7 Drawing Figures

PRIOR ART PHOSPHATING BATH ON LOW CARBON STEEL

PHOSPHATING BATH OF THE INVENTION ON LOW CARBON STEEL

PRIOR ART PHOSPHATING BATH
ON GALVANIZED ZINC

PHOSPHATING BATH OF THE INVENTION
ON GALVANIZED ZINC

NICKEL-FREE METAL PHOSPHATING COMPOSITION AND METHOD FOR USE

BACKGROUND OF THE INVENTION

1. Field of the Invention

This invention relates to phosphate conversion coatings for metal corrosion inhibition, particularly for substrates having two or more different metals whereby the substrate metals are simultaneously phosphated. The method of the invention is particularly useful for automotive body parts having joints of welded galvanized steel members where both steel (iron) and zinc are exposed. Good quality conversion coatings are obtained without "white spotting"; i.e. pitting of zinc substrates. Contemplated by the invention are the coated substrates themselves, solutions for coating them, and the methods for using these solutions.

2. Statement of Related Art

Phosphate conversion coatings for protecting corrodible metal surfaces and for providing a base for a paint or other finish coating are generally formed by treating a metal substrate wih a phosphating solution containing phosphoric acid and, usually, one or more additives such as oxidizing agents, acids, accelerators, or carriers.

The successful application of such phosphate conversion coatings to the metal substrate is dependent upon the reaction between the surface metal and the phosphating solution components; for example, in steel substrates, free iron ($Fe^{\circ}$) is oxidized and reacted to form the corresponding phosphate. While the reaction between iron and phosphoric acid theoretically proceeds with a concentrated solution of free phosphoric acid as sole reagent, it has been found that the resultant conversion coatings are not generally commercially acceptable. For example, oxidizing agents such as chlorate and/or nitrite ions are usually included in phosphating solutions for steel substrates to accelerate the interaction between steel and phosphoric acid in forming a crystalline phosphate coating on the steel surface.

In contrast, zinc surfaces such as galvanized steel are readily phosphated without the use of strong oxidizers, as the reaction of phosphoric acid with zinc to form the corresponding phosphate proceeds readily with hydrogen evolution. Not only are these phosphate coatings radily formed without the use of strong oxidizers, but the presence of oxidizers (particularly chlorates) in the phosphating solution generally causes pitting and etching of the substrate surface together with "white spot" (ZnO) formation. Even weak oxidizers such as nitrites, or free oxygen may cause pitting and white spots under high redox conditions, particularly at high free acidity.

Thus, phosphating solutions must be formulated with respect to the electrochemical characteristics of the metal substrate surface according to art-recognized principles. While these principles are readily applicable to the preparation of phosphating solutions for metal substrates having substantially uniform electrochemical surface characteristics, the formulation of phosphating solutions which simultaneously provide good-to-excellent coatings when two or more substances are present including at least one or more metal having different electrochemical surface characteristics, has not been entirely successful. Such multi-metal workpieces are frequently encountered in industry; e.g., automobile parts wherein two galvanized steel elements are joined, where electrogalvanized steel sheet metal is joined to non-galvanized cold rolled steel, where the workpiece has included impurities which may be other metals or inorganic materials, or where the workpiece is a discontinuous alloy. Substrates having more than one metal are conventioally phosphated under redox conditions sufficiently high to oxidize the substrate metal having the more negative redox potential, which frequently adversely affects the coating process for the substrate metal having the more positive redox potential. The problem is particularly associated with phosphating processes for substrates having steel and zinc surfaces as discussed above. Industry efforts to counteract zinc etching and white spot formation with reformulation baths having reduced amounts of carrier metal (nickel ions for example) have not heretofore produced the desired quality coatings. With increased use of galvanized steel for automobile parts routinely exposed to a corrosive environment, there is an industry need for a phosphating process which effectively will protect these parts and also provide a good base for finish coatings, particularly with respect to appearance, adhesion, coating weight, alkaline resistance and corrosion stability.

Prior art addressing this problem includes the disclosure of published Japanese patent application No. 81/108,682 filed June 24, 1982, and corresponding published Australian patent application No. 16,159/83, filed June 23, 1983, broadly relating to a phosphating solution including zinc, phosphate, and fluoride ions in specific concentrations useful on joined steel and galvanized steel substrates, such as encountered in contemporary automobile bodies.

U.S. Pat. No. 3,269,877 discloses a nickel-free phosphate coating composition which is limited in its disclosure to the coating of ferrous metal surfaces, and which includes cobalt ions.

Although not directed to the problem of phosphating two or more useful surfaces simultaneously, published PCT patent application Nos. WO84/00386 and WO85/03089 are of interest. These disclosures are directed to alkali resistant coatings which are made with primarily nickel-containing phosphating baths but do disclose nickel-free baths containing divalent metal cations whose hydroxides have a lower solubility in alkaline solution than iron or zinc, such as cobalt ions and other multivalent ions. The phosphate coating composition is critically controlled within a narrow range of components, so as to replace part of the zinc in the coating. The deposited coating contains at least 25% by weight of the coating of zinc and at least 15 mol percent of the total divalent cations in the coating comprise those metal cations whose solubility in alkali solution is less than that of zinc. Such coatings contain much higher than usual amounts of nonzinc metal in the coating.

SUMMARY OF THE INVENTION

This invention relates to compositions and methods for applying phosphate coatings to a substrate. The substrate may comprise one or more metals or at least on metal and one or more non-metal inorganic substances. In theory the invention overcomes the effect caused by the difference in redox potential when more than one substance is present, especially when they are in intimate contact. At least one of the substances present (I.e. in the workpiece) must be a metal which is to receive a phosphate (conversion) coating. When another substance is present, it may comprise one or more metals or non-metal inorganic materials. Other substances present in the workpiece may or may not also receive a phosphate coating, depending upon their nature. A compound substrate (i.e. having a metal to receive a phosphate coating and at least one other substance) may fall into any of the following categories.

(A) Multi-metallic compound substrates are those containing two or more (preferably two) discrete metals, usually in intimate contact, for example a continuous (uniform) steel alloy and zinc.

(B) Mixed compound substrates are those containing at least one metal and at least one non-metal inorganic, usually in intimate contact, for example a steel alloy and a ceramic, or a steel alloy, zinc, and a ceramic.

(C) Discontinuous compound substrates are those comprised primarily of a single metal or alloy which contains surface inclusion of another metal (or an unmixed alloy component) or a non-metallic inorganic substance, for example a discontinuous or low-grade steel alloy.

(D) Contamination compound substrates are those where a substantially pure substrate (usually a single metal or alloy) has small particles of another metal or non-metal inorganic, contaminating the surface, for example, galvanized steel with difficult to remove small steel alloy particles clinging to or imbedded in the surface.

The compositions and methods of this invention may be used on single metal substrates or any of the above compound substrates. In theory, they are particularly effective where two or more substances of differing redox potential are present in the substrate, especially where the difference in redox potentials is more than 0.75 volt. This capability is of great practical value, not only where a substrate of category A is to be phosphated, but also where substrates of differing natures are to be phosphated in a single bath or line, both single metal and compound, since the bath does not need to be changed.

Thus, in theory, the compositions and methods of this invention are particularly useful whenever a galvanic effect exists, caused by the presence of a metal substrate to be phosphated and at least one other metal substrate or non-metal inorganic substrate of differing redox potential. This is because the galvanic effect will prevent phosphate crystal formation in the immediate contiguous areas between the substrate substances, and the resulting unphosphated area will be subject to the formation of white spots and/or subsequent corrosion. This invention is theoretically particularly needed with increased redox potential differentials, reference being made to, for example, the "Handbook of Chemistry and Physics" 66th edition, CRC press, Boca Raton, Fla., USA (1985) at pages D-151 to D-158.

This invention is particularly efficacious when the redox potential differential is large, as frequently occurs when a negative redox potential substance (such as $Zn^{2+}$) is paired with a positive redox potential substance (such as $Fe^{3+}$, $Fe^{2+}$), For the purposes of this invention, any substantially continuous metal alloy or inorganic non-metal composition should be treated as a discrete element having a particular redox potential.

In its broadest terms, the inventive compositions are nickel-free, and comprise zinc ions, phosphate ions, at least one activating agent which is preferably cobalt cations, and at least two additional cations which theoretically are capable of reducing the effective redox potential differential between two or more substrate substances to 0.35 volts or less. Regardless of theory, the inventive compositions are particularly effective in forming phosphate coatings which were very difficult to achieve before, particularly (1) avoiding white spots on zinc substrates, (2) coating two or more metals simultaneously, and (3) coating a joint between two different metals with minimal passivated area.

Where specific embodiments are described below related to specific substrates, it should be understood that the inventive phosphating baths may be varied by changing the nature and relative amounts of the additional cations present, theoretically depending upon the redox potential differential of the substrates to be treated. So as to ensure that the effective redox potential differential is reduced to 0.35 volts or less. Other factors that must be considered are: (A) the environmenal hazards that may be presented by using othewise acceptable additional cations; (B) the unavilability of some additional cations due to infrequency of occurrence in nature, high cost of processing, etc.; or (C) the unsuitability of some additional cations because of incompatibility with one of the substrates being treated. Many additional cations that would otherwise be useful are outside the scope of this invention becuase they present one or more of the foregoing undesirable factors.

Because the inventive phosphating baths and methods can successfully phosphate coat at least one element substrate of a compound substrate, they are particularly useful for coating workpieces comprised of galvanized steel joints and/or cut ends, as well as those having exposed welds.

Baths according to this invention must be nickel free to avoid the known environmental hazards of nickel salts. In addition to zinc and phosphate ions, they contain nitrite ions (preferably) as a toner/accelerator, cobalt ions, at least two additional cations, and at least one buffering agent capable of maintaining the bath pH between 2.8 and 3.2. Depending upon the method of treatment (dipping, spraying, or various combinations thereof) contemplated substrates include iron and iron alloys of various types, zinc and zinc alloys, aluminum and aluminum alloys, some copper alloys, cadmium, chromium, magnesium, manganese, strontium, zirconuim, their alloys, cermamics of various compositions, and the like, as well as combinations of one or more of the above. Combinations of substrates where only one (or more) will accept an effective phosphate coating are also contemplated, since such substrates may demonstrate sufficient galvanic action in the presence of other metals or non-metal inorganics as to prevent effective phosphate coating along contiguous areas. Naturally, the inventive phosphating baths also may be used to coat a single substrate, the advantage being that their ability to coat various substrate combinations will permit a wider tolerance of inclusions and/or contaminants, or even a switch to another metal or a multi-metallic compound substrate without alteration of the bath composition. Furthermore, the inventive nickel-free compositions have proven to be particularly efficacious in coating galvanized steel, avoiding the generation of white spots without requiring precautions such as using distilled water.

DETAILED DESCRIPTION OF THE INVENTION

Figure 1A:
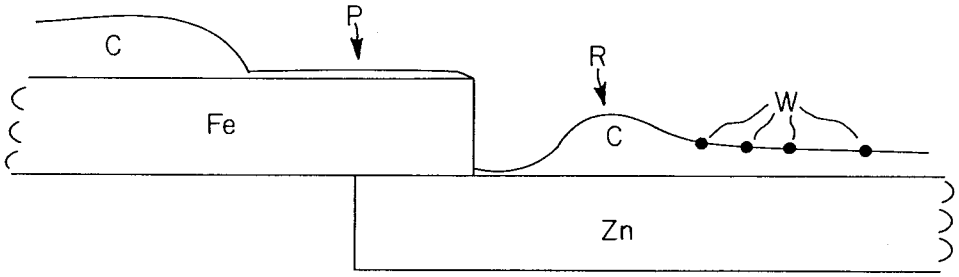
FIG. 1*a* is a notional sketch showing the phosphate coating at a steel-zinc (galvanized steel) joint using a phosphating solution according to the prior art.

Other than in the operating examples, or where otherwise indicated, all numbers expressing quantities of ingredients, reaction conditions, or defining ingredient parameters used herein are to be understood as modified in all instances by the term "about".

In the following description, the principles of the invention are discussed primarily with respect to the reduction of "steady-state" potentials between iron and zinc surfaces, as exemplified by a metal substrate (e.g., an automobile part) comprising a bare steel surface joined as by welding to an electrogalvanized (zinc) steel surface and then further in a steel-zinc-aluminum multimetallic substrate. However, the application of the invention to the minimization of redox potential differential between a variety of metals and at least one metal with an inorganic non-metal will be apparent to those skilled in the art, as will be the ready formation of phospahting solutions adapted for forming phosphate conversion coatings suitable for such substrates, according to the principles set forth herein. Moreover, although the theories disclosed herein are believed to explain the invention at least partially, it is not intended that the disclosures of compositions, methods, or products herein be bound by such theories. In accord with the theory of this invention, the redox potential difference between two or more disparate metals of a workpiece in the acidulated phosphate solution is preferably reduced by means of incorporating at least two, and most preferably three additional cations in the phosphating bath. Other theoretical means for reducing the redox potential difference may be electrochemical; i.e., by use of external electrical circuitry, but such systems are complex and costly and are not within the scope of this invention. As will be explained in detail below, the redox potential differential is apparently reduced to a point that the two or more substrates present theoretically act as a single substrate in the phosphating bath.

Phosphating solutions according to the invention suitable for a substrate having zinc and steel metal surfaces are nickel-free, but contain zinc, phosphate and cobalt ions, as well as at least two additional cations, which are presumed effective to reduce the oxidation-reduction potential differential between the substrate to be phosphated to 0.35 or less volts during phosphating, and a buffer sufficient to maintain the coating solution at a pH between 2.8 and 3.2. Solutions above or below this pH range are subject to gradually decreasing coating efficacy.

The zinc ions in the coating solution are preferably present as phosphate and nitrate salts and are at a concentration effective to form a phosphate coating, preferably 0.6–1.6 g/l, more preferably 0.9–1.2 g/l. The phosphate ions, preferably as zinc phosphate salts, are present in 20 to 32 g/l, preferably 24–28 g/l. The cobalt ions in the formulation are present in 0.2–0.8 g/l, preferably 0.2–0.6 g/l, most preferably 0.225–0.325 g/l.

Zinc phosphate coatings on a metal surface lead to a change of the electrochemical equilibrium at the interface of phosphate solution and metal. The redox potential on steel is believed to shift to the negative side and the redox potential on zinc shifts slightly to the positive side. Such a shift of the potential to the "steady-state" level is observable with a potentiostat, and it was found that the major shift in the potentials occurs in the first 5 to 10 seconds after the metals are immersed in the phosphate solution, after which the phosphating continues at essentially constant potentials. There are, however, various factors which may affect a redox potential measurement, including length of time, temperature of the composition, and the relative ion concentrations. As a result, the observations and theory related to redox potential disclosed herein may not be absolute.

Figure 6:
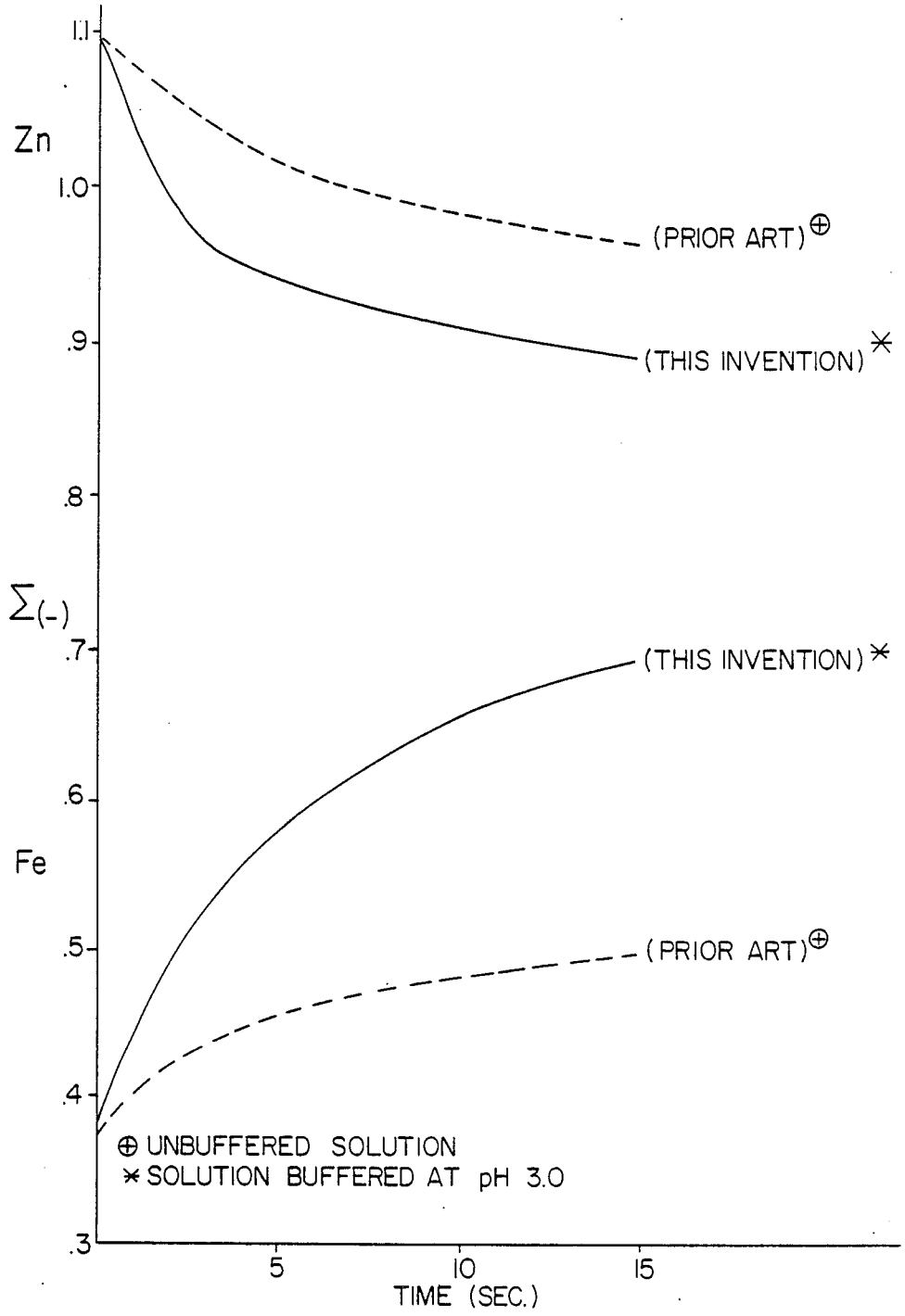
FIG. 6 is a notional graph illustrating the change in effective redox potentials of zinc (galvanized) and iron (steel) substrates, phosphated simultaneously according to the prior art and according to the practice of this invention.

As can be seen from FIG. 6, the theoretical voltage differential after 10 seconds for the prior art systems (dashed lines) is about 0.55 volts. In contrast to the prior art systems, the system of this invention obtains a low electronegative potential differential between the two substrates, an observed redox potential differential after 10 seconds being about 0.25–0.35 for zinc and steel, as shown by the solid lines of FIG. 6.

The greatest shift of redox potential to reduce the differential was observed to be made by the steel (iron), thus making it more like zinc in activity, rather than the zinc approaching the redox potential of iron. What is believed to be actually achieved by this reduction of redox differential is that the two different substrates in the coating bath act like a single common substrate or metal. As a result, the phosphating of the two substrates or compound substrate results in a uniform high quality coating on both which result has not been obtainable heretofore by prior art techniques.

As indicated, the critical means for obtaining the coatings according to this invention is by having at least two additional metal cations present in the phosphating formulation. The additional cations useful in the invention are believed to be categorized as those having a redox potential more negative than zinc by at least 0.2 volts in neutral solution (i.e. when measured in an aqueous system free of other electrolytes). These additional cations are distinguished from nickel cations which have a positive redox potential differential compared to zinc of more than 0.9. Regardless of theory, known useful additional cations are $Al^{+3}$, $Ba^{+2}$, $Ca^{+2}$, $Mg^{+2}$, $Mn^{+2}$, and $Sr^{+2}$. Two, especially three or more, different cations are preferably used. The additional cations are preferably added as nitrate salts in an amount sufficient to provide a phosphate to nitrate ratio ($PO_4^{-3}$:$NO_3^-$) of 0.5–20:1. Typical concentrations of preferred additional cations (as nitrates) are as shown in Table A:

TABLE A

| Cations | Conc. (g/l) |
|---|---|
| $Al^{+++}$ | 0.01 to 0.06 |
| $Ca^{++}$ | 0.10 to 0.55 |
| $Ba^{++}$ | 0.10 to 0.20 |

TABLE A-continued

| Cations | Conc. (g/l) |
|---|---|
| $Mg^{++}$ | 0.10 to 0.30 |
| $Mn^{++}$ | 0.10 to 0.80 |
| $Sr^{++}$ | 0.01 to 0.06 |

Although as indicated, $Al^{+3}$, $Ba^{+2}$, or $Sr^{+2}$ may comprise one or more of the at least two additional cations, it is preferred to use these cations at the lower concentration levels indicated because, under certain conditions, they may act as poisons to the system.

In a preferred embodiment of the invention, the additional cations are $Mn^{++}$ and $Ca^{++}$, especially when further combined with another of the above cations, most preferably $Mg^{++}$. The total amount of additional cations present in the bath theoretically should be sufficient to reduce the redox potential differential between the substrate elements present to 0.35 volts or less. When all are used, preferably the amount of $Mn^{++}$ ions will be greater than the amount of $Ca^{++}$ ions, and the amount of $Ca^{++}$ ions will be greater than the amount of $Mg^{++}$ ions. Most preferably 0.4–0.75 g/l $Mn^{++}$; 0.25 to 0.4 g/l of $Ca^{++}$; and 0.1 to 0.25 g/l of $Mg^{++}$; will be used.

As indicated, a buffer is also an essential component of the formulation of the invention. Any buffer may be used which will control the pH of the aqueous coating formulation to a value of from 2.8 to 3.2, however the invention will be discussed in terms of tartaric acid and its water soluble salts which are the preferred buffers. Other useful buffers are fluosilicic acid, boric acid, their water-soluble salts and mixtures of any of the foregoing. The ratio of tartaric acid buffer to phosphate ion ($PO_4^{-3}$) is generally 0.225–0.35:1, preferably 0.1–1:1. The acid content of the bath will be from 1.7 to 2.4 points of free acid titration. The bath preferably will also contain a rather high toner (nitrate) concentration on the order of from 0.12 to 0.2, preferably 0.15g/l, the nitrates preferably being as anions to the various cations present, particularly the additional cations.

The absence of nickel cations in the phosphate coating bath is also of critical importance. Nickel increases the mobility and adsorption of all ingredients during formation of the grain structure of phosphate coatings. Particularly on a zinc surface; nickel cations act as a carrier of ingredients to the surface; i.e., as a more positive ion nickel has a powerful attraction to the negative surface and carries other ions with it to the surface. The presence of nickel on the zinc metal surface also contributes to the formation of "white spots", which are pits of zinc oxide which may be caused by galvanic action between the nickel and the zinc. Nickel is also environmentally undesirable.

"White spots" are not acceptable on the phosphated surface, because they are responsible for subsequent pitting on the painted surface. Under the high redox conditions of a phosphate bath solution, white spots may form on zinc galvanized surfaces in the presence of any oxidant such as $NaClO_3$ or $NaNO_2$, or even ambient oxygen.

In the phosphate bath of the invention, the carrier is $Zn^{++}$, which becomes mobile enough toward a zinc suface because of adsorption on it or more negative ions (e.g. $Mg^{+2}$, $Ca^{+2}$, $Al^{+3}$, and the other additional cations) and because of the unexpected formation of negative phosphate crystals on zinc surfaces which contains $NO^{3-}$ moieties. Under such conditions, the $Zn^{++}$ ions have enough attractive forces to be as powerful a carrier as nickel. The mobility of the $Zn^{++}$ is particularly increased by the presence of a small amount of cobalt. Thus, the zinc ion in the present invention performs the carrying function of the nickel ion but is devoid of the galvanic action which may cause white spots.

It will be understood that other conventional additives may be present in the formulation of the invention, such as oxidizing agents, accelerators, carriers, and the like.

The total amount of additional cations (i.e. excluding zinc and cobalt) should be 30 to 70 mol %, preferably 40 to 50 mol %, based upon the total cations in the phosphating bath. A greater mol % affords no further advantage, while a lower mol % does not afford a satisfactory phosphate coating.

The methods of the present invention for phosphating metal surfaces using the inventive phosphating solutions comprise spray treatment, dip treatment, or a combination of such treatments. Spray treatment can usually be effected by spraying for 5 or more seconds in order to form an adequate phosphate film which exhibits the desired performance characteristics. The spray treatment can be carried out using a discontinuous cycle, preferably comprising first spraying for about 5 to 30 seconds, followed by discontinuing the treatment for about 5 to 30 seconds, and then spraying again for at least 5 seconds, with a total spray treatment time of at least 40 seconds. This cycle can be carried out one or more times. Spray treatment is particularly effective where aluminum is a substrate ingredient.

Dip treatment is more preferable than spray treatment in the methods of the present invention. In order to form an adequate phosphate film which exhibits the desired performance characteristics, the dip treatment is usually effected for at least 15 seconds, preferably for about 30 to about 120 seconds. A treatment using a combination of spraying and dipping, can be carried out by first dipping for at least 15 seconds and then spraying for at least 2 seconds. Alternatively, the treatment can be effected by first spraying for at least 5 seconds, and then dipping for at least 15 seconds. The former combination of first dipping then spraying is especially advantageous for articles having complicated shapes, such as a car body. For such articles, it may be preferable first to dip from 30 to 90 seconds, and then spray for 5 to 45 seconds. In this treatment process, it is advantageous to effect the spraying for as long a time as is possible within the limitations of the automotive production line, in order to remove the sludge which adheres to the article during the dipping stage.

In the inventive methods, the treating temperature can be from 40° to 65° C., preferably from 45° to 60° C. This temperature range is approximately 10° to b 15° C. lower than that which is used in the prior art methods. When the treating temperature is too high, the phosphating accelerator is decomposed and excess precipitate is formed, causing the components in the solution to become unbalanced and making it difficult to obtain satisfactory phosphate films.

In spray treatments, conventional spray pressures can be used, 0.5 to 2 kg/cm$^2$ being preferred.

An advantageous procedure for treating metal surfaces using a series of pre-coating treatment processes followed by phosphating in accordance with the process of the present invention is as follows:

A metal surface is first subjected to a spray treatment and/or a dip treatment with an alkaline degreasing agent at a temperature of 50° to 60° C. for 2 minutes; followed by washing with tap water; spray treatment and/or dip treatment with a surface conditioner at room temperature for 10 to 30 seconds; dip treatment with the solution of the present invention at a temperature of 30° to 70° C. for at least 15 seconds; and washing with tap water and then with deionized water; in that order. Thereafter, it is desirable to after-treat with an acidulated rinse common to the industry such as a dilute chromate solution. This after-treatment is preferably adopted even when the present invention is carried out by spray treatment, or by a combined tratment comprising a spray treatment followed by a dip treatment. By introducing this after-treatment a phosphate coating is obtained which gives greater corrosion resistance to a siccative coating.

The coatings which are obtained by the process of the invention have a crystal structure significantly different from zinc phosphate coatings obtained heretofore. The crystal structure is exceedingly fine (1 to 3 microns) which results in a tight coating with little or no powdering; i.e., the adhesion of coating to metal substrate is excellent.

Figure 1B:
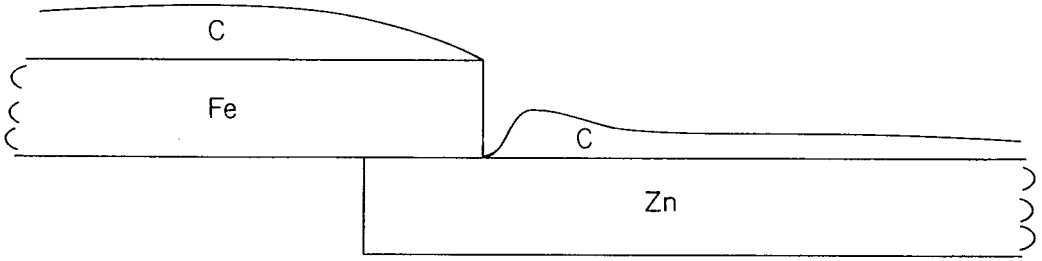
FIG. 1*b* is a notional sketch of is the same joint after phosphation according to the practice of this invention.

FIGS. 1*a* and and 1*b* are notional illustrations according to theory of the manner in which the compositions and methods of this invention improve the phosphate coating of a metal substrate in the presence of another metal or a non-metal inorganic. The work-piece shown is a multi-metallic compound substrate comprised of a steel surface flap welded to a zinc (galvanized) surface, which is a preferred substrate for the compositions and methods of this invention. FIG. 1*a* shows phosphatization with a prior art composition. It should be noted that the steel substrate has a substantial area contiguous to the zinc substrate which is designated a "passivation" area P, indicating that either no phosphate coating C is deposited or, even more undesirably, an iron oxide coating has formed. Subsequent paint adhesion is difficult to achieve in a passivation area. The phosphate coating on the zinc substrate does not closely approach the steel substrate, and builds up a thick formation in a ridge R along the point of contact. Most undesireably, a phosphate bath designed to coat the steel, will result in zinc oxide "white spots" W on the zinc, which are points of future corrosion (pitting). FIG. 1*b* shows a phosphate coating according to this invention, it being noted that the coating on the steel is almost complete (there is minimal or no passivation area), the coating on the zinc more closely approaches the steel, and there is a total elimination of the white spots.

Figure 2:
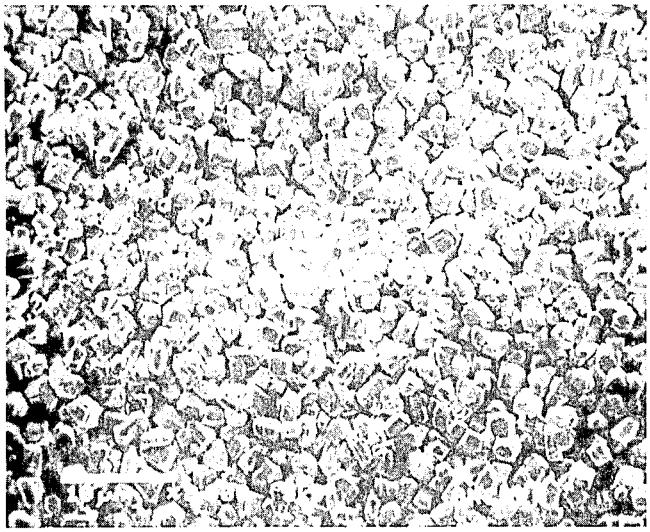
FIGS. 2 to 5 are a series of electromicrographs (2000×) comparing phosphate grain structures of phosphate coatings according to the prior art and according to the present invention.
Figure 3:
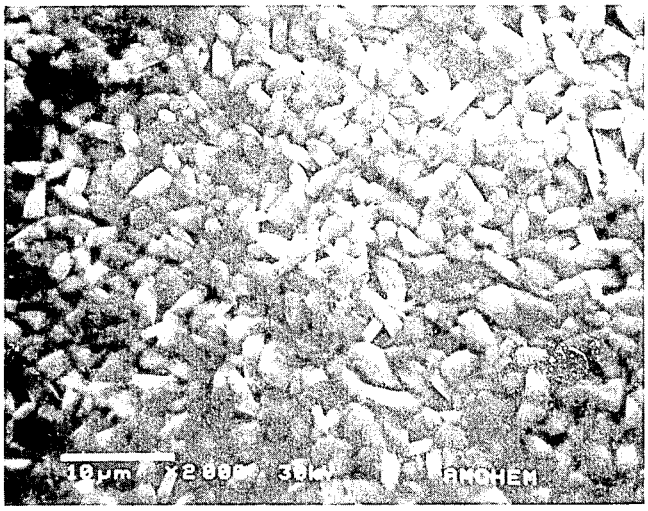
Figure 4:
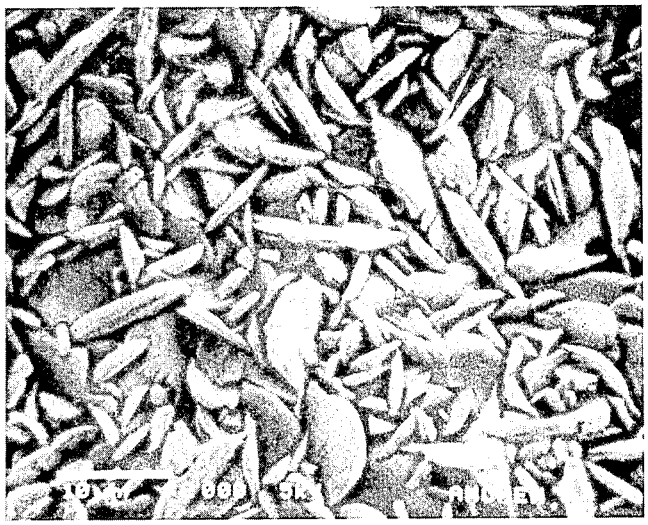
Figure 5:
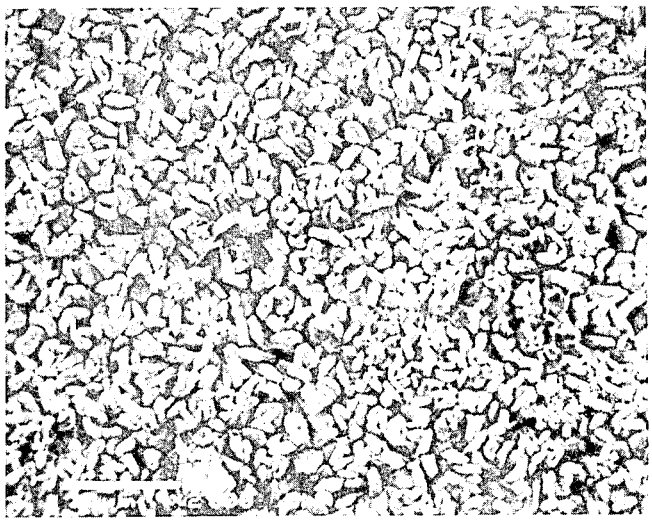

FIGS. 2 to 5 are scanning electron microscope pictures which show the grain structure of prior art phosphate coatings and those of the invention. FIG. 2 shows a phosphated surface of low carbon steel using prior art nickel-containing phosphating baths and it is seen that the structure appears as cubic grains whereas the surface of such steel phosphated in the nickel-free phosphating solution of the invention as shown in FIG. 3 appears as ovoid grains. FIG. 4 shows the surface of hot dipped galvanized zinc phosphated by a prior art method and solution in which the surface grains are quite different from those of FIG. 5 where the phosphating solution is the nickel-free solution of the invention. Also of significance is the fact that the surface grains of FIGS. 3 and 5 more closely resemble each other than do the prior art treated materials (FIGS. 2 and 4) and this is believed to reflect the smaller redox potential differential between the metals which is achieved by this invention and which causes the metals to act as a common metal.

FIG. 6 is a notional graph based upon a compilation of some test results and some theoretical speculations which illustrates how much closer the effective redox potentials of zinc (galvanized) and steel approach each other using the compositions and methods of this invention, as compared to the prior art. The closer the redox potentials (i.e. the smaller the reodx potential differential), the more the substrate is believed to act as a "common metal", and the better the phospahte coating.

The following examples are illustrative of the practice of the invention.

EXAMPLE I

Phosphating compositions were prepared having the components set forth in the following Table B and were evaluated with zinc/steel substrates in standard tests.

TABLE B

| | BATH COMPOSITION g/l | | | | | | | | | | |
|---|---|---|---|---|---|---|---|---|---|---|---|
| Bath # | $PO_4^{---}$ | $NO_3^-$ or $SO_4^{--}$ | $Zn^{++}$ | $Co^{++}$ | $Mg^{++}$ | $Ca^{++}$ | $Mn^{++}$ | Tartaric acid | Free Fluoride $F^-$ | $NO_2^-$ ml Toner | Free Acidity ml titer |
| 1 | 30 | 10.0 | 1.4 | 0.25 | 0.25 | 0.6 | 0.8 | 1.0 | 7.0 | 3.0 | 2.4 |
| 2 | 25 | 8.0 | 1.2 | 0.25 | 0.20 | 0.4 | 0.6 | 0.8 | 0.8 | 2.8 | 2.0 |
| 3 | 25 | 6.0 | 1.0 | 0.25 | 0.15 | 0.3 | 0.4 | 0.6 | 0.6 | 2.6 | 1.6 |
| 4 | 18 | 4.0 | 0.8 | 0.25 | 0.10 | 0.2 | 0.2 | 0.5 | 0.5 | 2.4 | 1.2 |
| 5C | 16 | 3.0 | 0.7 | 0.25 | 0.05 | 0.1 | 0.05 | 0.3 | 0.4 | 2.0 | 1.0 |
| 6C | 14 | 3.0 | 0.7 | 0.25 | — | — | — | 0.1 | 0.3 | 1.8 | 0.9 |
| 7C | 14 | 3.0 | 0.7 | 0.25 | — | — | — | — | 0.2 | 1.6 | 0.6 |
| 8C | 14 | 3.0 | 0.6 | 0.25 | — | — | — | — | 0.1 | 1.4 | 0.4 |

C = Comparison example

Baths 1 to 4 were according to this invention and produced coatings on zinc/steel compound substrates having excellent adhesion and acceptable cosmetic appearance, and were free of white spots when evaluated by accepted standards.

When the additional cation content is reduced below that of the invention or absent (comparison baths 5C to 8C), adhesion of the phosphate coating decreases and, as a result, the baths no longer afford the advantages of this invention.

Where a steel substrate welded to a zinc (galvanized steel) substrate was phosphated, the composition of the formed phosphate coatings (in mol %) typically was as shown in Table C.

TABLE C

| Cation (++) | Steel Substrate | Zinc Substrate |
|---|---|---|
| Zn | 33.0 to 65.0 | 90.7 to 92.0 |
| Fe | 30.7 to 58.8 | none |
| Co | 1.25 to 1.5 | 2.5 to 2.8 |
| Mn | 1.0 to 2.6 | 5.1 to 5.6 |
| Mg | 0.16 to 0.95 | 0.2 to 0.35 |

TABLE C-continued

| Cation (++) | Steel Substrate | Zinc Substrate |
|---|---|---|
| Ca | 1.8 to 4.2 | 0.10 to 0.28 |
| Total mol % | 4.21 to 9.2 | 8.1 to 9.3 |

There was an observed discontinuity of about 0.5–5.0 mm (i.e. the thickness of the metal abutting plate edge), between the two substrate coatings.

EXAMPLE II

The following bath compositions exemplify phosphating solutions according to the invention; each composition was applied under conditions indicated by spray or by dip according to known prior art processes.

| Bath Composition #9 | g/l |
|---|---|
| (1) $Mg^{++}$ (as nitrate) | 0.30 |
| (2) $Mn^{++}$ (as phosphate) | 0.25 |
| (3) $Al^{+++}$ (as nitrate) | 0.01 |
| (4) $Zn^{++}$ (as phosphate) | 1.5 |
| (5) $PO_4^{---}$ (as Zinc phosphate and $H_3PO_4$) | 26.0 |
| (6) $NO_3^-$ (as Mg, Al and sodium) | 10.0 |
| (7) $NaClO_3$ | 0.5 |
| (8) Tartaric Acid | 1.0 |
| (9) NaOH (to adjust to pH 3.0) | |
| (10) Cobalt (as phosphate) | 0.25 |
| (11) $NaNO_2$ | 0.20 |
| Free acidity | 1.5 ml titration |

The above bath was employed at from 120° F. to 140° F. (49° C. to 60° C.) and was used in dip applications.

Zinc and steel substrates were simultaneously phosphated by bath immersion for two minutes. The redox potential differential between these metals was recorded by means of a potentiostat corrosion meter (EC G Parc-Model No. 350A). The observed initial redox potential differential was 0.61 volts which dropped to 0.34 volts within 5 seconds.

The Zn/steel substrates which were coated with the above bath had an excellent cosmetic appearance with a coating weight on steel of 1.56 to 1.72 g/m$^2$ and on zinc of 2.0 to 2.15 g/m$^2$. The adhesion impact test rating was 10 (steel and zinc surface). The mol percent of total metal cations in the coatings of each metal substrate is shown in the following Table D. The additional cations totalled about 6.1 mol %.

TABLE D

| (Amount of Metals in the Coatings) | Mol % |
|---|---|
| Steel Substrate | |
| Al | 0.011 |
| Mn | 1.48 |
| Mg | 0.26 |
| Co | 1.08 |
| Zinc Substrate | |
| Al | 0.015 |
| Mn | 1.40 |
| Mg | 0.15 |
| Co | 1.15 |

| Bath Composition #10 | g/l |
|---|---|
| (1) $Mn^{++}$ (as phosphate) | 0.4 |
| (2) $Ca^{++}$ (as phosphate) | 0.3 |
| (3) $Zn^{++}$ (as phosphate) | 1.3 |
| (4) $PO_4^{---}$ (as Zn phosphate and as $H_3PO_4$) | 20.0 |
| (5) $Co^{++}$ (as sulfate) | 0.25 |
| (6) $NO_3^{--}$ (as sodium nitrate) | 4.0 |
| (7) Tartaric Acid | 0.6 |
| (8) $NaNO_2$ | 0.15 |
| Free acidity | 1.5 ml titration |

Zinc and steel substrates were sumultaneously phosphated by immersion for two minutes as with Bath Composition #9. The observed initial redox potential differential was 0.64 volts which droppd to 0.30 volts within 5 seconds.

The bath was used at a temperature of 120° to 140° F. (49° to 60° C.) and resulted in excellent cosmetic appearance of the treated substrates. The average coating weight was 1.94 g/m$^2$, and the adhesion impact test rating was 9 which is acceptable but not preferred. The mol percent of metal cations in the coatings on each metal substrate is shown in the following Table E.

TABLE E

| (Amount of Metals in the Coatings) | Mol % |
|---|---|
| Steel Substrate | |
| Mn | 1.27 |
| Ca | 6.80 |
| Co | 1.10 |
| Zinc Substrate | |
| Mn | 0.41 |
| Ca | 0.44 |
| Co | 1.12 |

| Bath Composition #11 | g/l |
|---|---|
| (1) $Ca^{++}$ (as sulfate) | 0.35 |
| (2) $Mg^{++}$ (as nitrate) | 0.5 |
| (3) $Zn^{++}$ (as phosphate) | 1.2 |
| (4) $PO_4^{---}$ (as $ZnHPO_4$ and $H_3PO_4$) | 20.0 |
| (5) $NO_3^-$ (as $NaNO_3$) | 4.0 |
| (6) Tartaric acid | 0.65 |
| (7) $Co^{++}$ (as nitrate) | 0.25 |
| (8) $NaNO_2$ | 0.85 |
| Free acidity | 1.7 ml titration |

Zinc and steel substrates were phospated for two minutes as described above. The observe initial redox potential differential was 0.64 volts which dropped to 0.32 volts within 5 seconds.

Excellent coatings with good cosmetic appearance were obtained. The coating weight on steel was 0.97g/m$^2$ and on zinc was 1.29g/m$^2$. The adhesion impact test rating was 8. The mol percent of metal cations in the coatings on each metal substrate is shown in the following Table F.

TABLE F

| (Amount of Metals in the Coatings) | Mol % |
|---|---|
| Steel Substrate | |
| Ca | 3.19 |
| Mg | 0.28 |
| Co | 1.26 |
| Zinc Substrate | |
| Ca | 0.54 |

TABLE F-continued

| (Amount of Metals in the Coatings) | Mol % |
|---|---|
| Mg | 0.21 |
| Co | 1.28 |

| Bath Composition #12 | g/l |
|---|---|
| (1) $Mg^{++}$ (as nitrate) | 0.2 |
| (2) $Mn^{++}$ (as nitrate) | 0.8 |
| (3) $Ca^{++}$ (as phosphate or nitrate) | 0.4 |
| (4) $PO_4^{---}$ (as Zinc phosphate and $H_3PO_4$) | 26.0 |
| (5) $Zn^{++}$ (as phosphate) | 1.2 |
| (6) Tartaric Acid | 0.1 |
| (7) $NO_3^-$ (as $NaNO_3$) | 2.0 |
| (8) $Co^{++}$ (as phosphate) | 0.25 |
| (9) $NaNO_2$ | 0.2 |
| Free acidity | 1.7 ml titration |

A thin uniform phosphate coating was obtained. The coating weight on steel was 1.13 g/m$^2$ and on zinc was 1.29 g/m$^2$. The adhesion impact test rating was 7.5. The mol percent of metal cations in the coatings on each metal substrate is shown in the following Table G.

TABLE G

| (Amount of Metals in the Coatings) | Mol % |
|---|---|
| Steel Substrate | |
| Mg | 1.03 |
| Mn | 3.21 |
| Ca | 8.01 |
| Co | 1.35 |
| Zinc Substrate | |
| Mg | 0.81 |
| Mn | 3.10 |
| Ca | 0.71 |
| Co | 1.32 |

| Bath Composition #13 | g/l |
|---|---|
| (1) $Mg^{++}$ (as phosphate or nitrate) | 0.25 |
| (2) $Mn^{++}$ (as phosphate or nitrate) | 0.80 |
| (3) $Ca^{++}$ (as phosphate or nitrate) | 0.35 |
| (4) $PO_4^{---}$ (as Zinc phosphate and $H_3PO_4$) | 26.0 |
| (5) $Zn^{++}$ (as phosphate) | 1.2 |
| (6) Tartaric Acid | 0.65 |
| (7) $NO_3^-$ (as $NaNO_3$) | 4.0 |
| (8) $NaNO_2$ | 0.25 |
| (9) $Co^{++}$ (as nitrate) | 0.25 |
| Free acidity | 1.9 ml titration |

As in the above baths, zinc and steel substrates were simultaneously phosphated by immersion for two minutes. The observed initial redox potential differential was 0.62 volts which dropped within 5 seconds to 0.28 volts.

Excellent coatings with good cosmetic appearance were obtained. The coating weight on steel was 1.5 g/m$^2$ and on zinc was 1.8 g/m$^2$. The adhesion test impact test rating was 10.0. The mol percent of the metal cations in the coatings on each metal substrate is shown in the following Table H. The total mol % of additive divalent cations did not exceed 8 mol %.

TABLE H

| (Amount of Metals in the Coatings) | Mol % |
|---|---|
| Steel Substrate | |
| Mg | 0.91 |
| Mn | 2.10 |
| Ca | 4.15 |
| Co | 1.30 |
| Zinc Substrate | |
| Mg | 0.71 |
| Mn | 3.00 |
| Ca | 0.26 |
| Co | 1.30 |

| Bath Composition #14 | g/l |
|---|---|
| (1) $Sr^{++}$ (as nitrate) | 0.05 |
| (2) $Ca^{++}$ (as phosphate) | 0.35 |
| (3) $PO_4^{---}$ (as phosphate) | 24.0 |
| (4) $Zn^{++}$ (as phosphate) | 1.10 |
| (5) $Co^{++}$ (as phosphate) | 0.45 |
| (6) $NO_3^-$ (as sodium and strontium nitrate) | 3.0 |
| (7) Tartaric acid | 0.5 |
| (8) $NaNO_2$ | 0.25 |
| Free acidity | 1.8 ml of titration |

The above bath was employed at 130° F. (54.5° C.) and was used for dip application. Zinc and steel substrates were simultaneously phosphated for two minutes. The zinc/steel substrates which were coated with the above bath had an excellent cosmetic appearance with a coating weight on steel of 1.40–1.5 g/m$^2$ and on zinc of 1.80 to 2.03 g/m$^2$. The adhesion impact test rating was 9.0 (steel and zinc surface). The weight and mol percent of total metal cations in the coatings of each metal substrate is shown in the following Table I. The additional cations totaled about 6.42 mol %.

TABLE I

| (Amount of metals in the coatings) | Mol % |
|---|---|
| Steel Substrate | |
| Sr | 0.12 |
| Ca | 5.10 |
| Co | 1.20 |
| Zinc Substrate | |
| Sr | 0.12 |
| Ca | 0.55 |
| Co | 1.15 |

| Bath Composition #15 | g/l |
|---|---|
| (1) $Ba^{++}$ (as nitrate or phosphate) | 0.15 |
| (2) $Mn^{++}$ (as sulfate or nitrate) | 0.70 |
| (3) $PO_4^{---}$ (as $ZnHPO_4$ and $H_3PO_4$) | 26.0 |
| (4) $Zn^{++}$ (as phosphate) | 1.2 |
| (5) $Co^{++}$ (as phosphate) | 0.50 |
| (6) Tartaric acid | 0.60 |
| (7) $NO_3^-$ (as sodium nitrate) | 4.0 |
| (8) Free acidity | 1.9 ml titration |

As in the above baths, zinc and steel substrates were simultaneously phosphated by immersion for 2 minutes.

Excellent coating with good cosmetic appearance was obtained.

Coatings weight on steel was 1.4 g/m$^2$ and on zinc was 1.65 g/m$^2$. The adhesion test impact test rating was 9.5. The weight and mol percent of the metal cations in the coatings on each metal substrate is shown in the following Table J. The total mol % of additional cations did not exceed 5.95 mol %.

TABLE J

| (Amount of metals in the coatings) | Mol % |
|---|---|
| Steel Substrate | |
| Ba | 0.08 |
| Mn | 1.60 |
| Co | 1.20 |
| Zinc Substrate | |
| Ba | 0.20 |
| Mn | 2.75 |
| Co | 1.20 |

EXAMPLE 16

In order to illustrate the utility of the inventive phosphating coatings on other metals, a two-dimensional substrate was prepared of strips of zinc, steel, and aluminum, welded along their lengths. The aluminum was aluminum alloy metal sheet (Al-2036) used in the automotive industry.

The bath composition was as follows:

| | g/l |
|---|---|
| (1) $Mg^{++}$ (as nitrate) | 0.2 |
| (2) $Mn^{++}$ (as nitrate) | 0.6 |
| (3) $Ca^{++}$ (as phosphate or nitrate) | 0.3 |
| (4) $PO_4^{---}$ (as phosphate) | 26.0 |
| (5) $Zn^{++}$ (as phosphate) | 1.2 |
| (6) $NO_3^-$ (as anion in $NaNO_3$) | 2.0 |
| (7) $Co^{++}$ (as phosphate) | 0.4 |
| (8) Tartaric acid | 0.5 |
| (9)* fluosilicic acid | 1.5 |
| (10)* $F^-$ (as anion in HF) | 0.4 |
| (11) $NaNO_2$ | 0.18 |
| Free acidity | 1.2 ml titration |

*Different fluorides must be employed when phosphating an aluminum substrate to remove oxide film.

The above composite substrate was immersed in the above bath composition at a temperature of 130° F. (54.5° C.) for two minutes, to obtain a phosphate coating on all three metals. The cosmetic appearance of all three coatings was excellent, with coating weights of: zinc—1.65 to 1.70 g/m$^2$; steel—1.45 to 1.62 g/m$^2$; and aluminum—about 0.2 g/m$^2$. The adhesion impact test rating was 10 on steel and zinc and 8.0 on aluminum.

The mol percent of the total metal cations in the coatings of each metal in the substrate is shown in Table K. The additional cations totaled about 6.0 mol %.

TABLE K

| (Amount of metals in the coatings) | Mol % |
|---|---|
| Steel Substrate | |
| Mn | 1.5 |
| Mg | 0.25 |
| Ca | 1.16 |
| Co | 1.06 |
| Zinc Substrate | |
| Mn | 1.7 |
| Mg | 0.15 |
| Ca | 0.55 |
| Co | 1.20 |
| Aluminum Substrate | |
| Mn | 0.14 |
| Mg | 0.05 |
| Ca | 0.03 |

TABLE K-continued

| (Amount of metals in the coatings) | Mol % |
|---|---|
| Co | 0.01 |

EXAMPLE 17

In order to demonstrate the method of spraying the inventive composition, a phosphating bath with the following composition was prepared.

| | g/l |
|---|---|
| (1) $Mg^{++}$ (as nitrate) | 0.15 |
| (2) $Mn^{++}$ (as nitrate or phosphate) | 0.30 |
| (3) $Ca^{++}$ (as phosphate) | 0.22 |
| (4) $Zn^{++}$ (as phosphate) | 1.2 |
| (5) $Co^{++}$ (as phosphate) | 0.25 |
| (6) $PO_4^{---}$ (as phosphoric acid and phosphates) | 26.0 |
| (7) Tartaric acid | 1.0 |
| (8) $NaNO_2$ | 0.20 |
| (9) NaOH (to adjust pH to 3.0) | |
| Free acidity | 1.6 ml titration |

The above composition was employed at 125°-135° F. (49°-56° C.) and was sprayed using conventional spray equipment in a conventional manner for one minute. zinc and steel substrates were phosphated simultaneously. Both the zinc and the steel substrates upon coating had an excellent cosmetic appearance, with a coating weight on steel of 1.00-1.35 g/m$^2$ and on zinc of 1.40 to 1.70 g/m$^2$. The adhesion impact test ratings were 9 (steel) and 10 (zinc). The mol % of the total metal cations in the coating of each metal substrate is shown in Table L. The additional cations totaled about 8.13%.

TABLE L

| (Amount of metal in the coatings) | Mol % |
|---|---|
| Steel Substrate | |
| Mg | 0.25 |
| Mn | 1.58 |
| Ca | 4.85 |
| Co | 1.20 |
| Zinc Substrate | |
| Mg | 0.20 |
| Mn | 1.45 |
| Ca | 0.10 |
| Co | 1.20 |

EXAMPLE 18

A direct comparison was made between a welded zinc/steel joint substrate (A) phosphated with a solution according to this invention and an identical substrate (B) phosphated with a commercial product which contains nickel ions and does not have this invention's additional cations.

The comparison was based upon coating weights and the morphology of the joint area, utilizing photomicrographs. The following observations were made.

(1) On the steel substrate, samples (A) and (B) both showed larger phosphate crystals near the joint and smaller crystals further away.

(2) On the zinc substrate, samples (A) and (B) both showed smaller phosphate crystals near the joint and larger crystals further away.

(3) However, substrate (A) consistently showed larger crystalline structure (11–15 microns) than substrate (B) (about 5 microns) on steel, thus demonstrating a distinct difference between them. Moreover, both metals of (A) showed a superior cosmetic appearance to both metals of (B).

(4) In terms of coating weights, the substrate (A) coated according to this invention shows a very desirable uniform coating weight in all areas. In contrast, the substrate (B) coated with the prior art nickel-containing composition clearly showed undesirable lower coating weights in the joint areas for both steel and zinc. Actual numerical results are shown in the following Table M.

TABLE M

| | Steel | | Zinc | |
|---|---|---|---|---|
| Substrate | remote from joint | near joint | remote from joint | near joint |
| A | 288 | 288 | 329 | 290 |
| B | 296 | 255 | 250 | 365 |

(5) A distinctly lighter colored area on the steel near the joint was observed in (B). A similar area could not be observed in (A). The lighter colored area is considered to be an indication of passivation or partial passivation.

Based upon the above, one must conclude that the prior art composition, although producing a reasonably satisfactory phosphate coating on individual metals, produces an inferior phosphate coating at a steel/galvanized steel joint. In contrast, the compositions and methods of this invention produce superior phosphate coatings which almost completely protect such a joint. As disclosed earlier in the specification, a lower coating weight near a joint indicates a probable area of passivation, which will make that area more subject to corrosion. Additionally, an unequal coating weight distribution will result in an uneven surface on the finished (painted) product, whose appearance will be unsatisfactory and which will have failure spots at the points of unevenness.

We claim:

1. A nickel-free aqueous solution for depositing a phosphate coating on a substrate of one or more metals simultaneously comprising the following, each present in a phosphating-effecting amount:
(A) phosphate anions;
(B) zinc cations;
(C) cobalt cations;
(D) at least one buffer capable of, and present in an amount sufficient to, maintain the solution pH at about 2.8 to 3.2; and
(E) two or more of the group comprising: $Al^{+++}$, $Ba^{++}$, $Ca^{++}$, $Mg^{++}$, $Mn^{++}$, and $Sr^{++}$.

2. The solution of claim 1 wherein said cobalt cations are present in about 0.2 to 0.8 g/l.

3. The solution of claim 1 wherein said solution consists essentially of the stated components and each said additional cation, when present, is in an amount of:
(1) $Al^{+++}$—about 0.01 to 0.06 g/l;
(2) $Ba^{++}$—about 0.10 to 0.20 g/l;
(3) $Ca^{++}$—about 0.10 to 0.55 g/l;
(4) $Mg^{++}$—about 0.10 to 0.30 g/l;
(5) $Mn^{++}$—about 0.10 to 0.80 g/l;
(6) $Sr^{++}$—about 0.01 to 0.06 g/l.

4. The solution of claim 2 wherein said solution consists essentially of the stated components and each said additional cation, when present, is in an amount of:
(1) $Al^{+++}$—about 0.01 to 0.06 g/l;
(2) $Ba^{++}$—about 0.10 to 0.20 g/l;
(3) $Ca^{++}$—about 0.10 to 0.55 g/l;
(4) $Mg^{++}$—about 0.10 to 0.30 g/l;
(5) $Mn^{++}$—about 0.10 to 0.80 g/l;
(6) $Sr^{++}$—about 0.01 to 0.06 g/l.

5. The solution of claim 1 wherein said phosphate anions are present in about 20 to 32 g/l.

6. The solution of claim 4 wherein said phosphate anions are present in about 24 to 28 g/l.

7. The solution of claim wherein said zinc cations are present in about 0.6 to 1.6 g/l.

8. The solution of claim 6 wherein said zinc cations are present in about 0.9 to 1.2 g/l.

9. The solution of claim 1 wherein said cobalt cations are present in about 0.2 to 0.8 g/l.

10. The solution of claim 3 wherein said cobalt cations are present in about 0.2 to 0.6 g/l.

11. The solution of claim 8 wherein said cobalt cations are present in about 0.225 to 0.325 g/l.

12. The solution of claim 3 wherein three said additional cations are present.

13. The solution of claim 11 wherein the additional cations present are $Ca^{++}$ and $Mn^{++}$.

14. The solution of claim 11 wherein the additional cations present are $Ca^{++}$, $Mn^{++}$, and one other additional cation.

15. The solution of claim 11 wherein the additional cations present are $Ca^{++}$, $Mn^{++}$, and $Mg^{++}$.

16. The solution of claim 15 wherein the amount of $Mn^{++}$ cations present is greater than the amount of $Ca^{++}$ cations present and the amount of $Ca^{++}$ cations present is greater than the amount of $Mg^{++}$ cations present.

17. The solution of claim 1 wherein said at least one buffer is tataric acid, fluosilicic acid, boric acid, or a water-soluble salt thereof.

18. The solution of claim 16 wherein said at least one buffer is tartaric acid present in a ratio tartaric acid:-phosphate anion of 0.225–0.35:1.

19. The solution of claim 1 wherein nitrate anions are present in addition to said phosphate anions.

20. A nickel-free aqueous solution for depositing a phosphate coating on a substrate of one or more metals simultaneously comprising;
(A) phosphate ions,
(B) zinc ions,
(C) cobalt ions,
(D) at least one buffer capable of maintaining the pH of the solution at about 2.8 to 3.2, and
(E) at least two additional cations other than nickel or those above, present in an amount effective to reduce the redox potential differential when more than one substrate is present, to less than about 0.35 volts between said substrates.

21. A method for depositing a phosphating coating on a substrate of one or more metals simultaneously comprising applying thereto the nickel-free aqueous solution of claim 1 in a phosphating-effective manner.

22. The method of claim 21 wherein said application is by dipping, spraying, or any combination thereof.

23. The method of claim 22 wherein said substrate is at least one metal containing an inclusion or an adhering contaminant particle.

24. The method of claim 22 wherein said substrate comprises at least two metals.

25. The method of claim 22 wherein said substrate comprises at least two of iron or an alloy thereof, of zinc or galvanized steel, or aluminum.

26. The method of claim 22 wherein said substrate comprises a joint of at least two metals.

27. The method of claim 22 wherein said substrate comprises a welded joint of steel and galvanized steel.

28. The product of the method of claim 21.

29. The product of the method of claim 27.

30. A nickel-free aqueous solution for depositing a phosphate coating. on a substrate having different electrochemical surface characteristics comprising:

(A) phosphate ions,
(B) zinc ions,
(C) cobalt ions,
(D) at least one buffer capable of maintaining the pH of said solution at about 2.8 to about 3.2, and
(E) at least two additional cations other than nickel or those above, present in an amount effective to reduce the redox potential differential of said substrate to less than about 0.35 volts.

31. A method for depositing a phosphate coating on a substrate having different electrochemical surface characteristics comprising contacting said substrate with a nickel-free aqueous solution comprising;

(A) phosphate ions,
(B) zinc ions,
(C) cobalt ions,
(D) at least one buffer capable of maintaining the pH of said solution at about 2.8 to about 3.2, and
(E) at least two additional cations other than nickel or those above, present in an amount effective to reduce the redox potential differential of said substrate to less than about 0.35 volts.

32. The product of the method of claim 31.

33. A method for providing a corrosion-inhibiting coating on a substrate having different electrochemical surface characteristics comprising contacting said substrate with a nickel-free aqueous solution comprising:

(A) phosphate ions,
(B) zinc ions,
(C) cobalt ions,
(D) at least one buffer capable of maintaining the pH of said solution at about 2.8 to about 3.2, and
(E) at least two additional cations other than nickel or those above, present in an amount effective to reduce the redox potential differential of said substrate to less than about 0.35 volts.

34. A method for providing corrosion-inhibiting coatings on first and second substrates, each having different electrochemical surface characterisics, and each in intimate contact with each other, comprising simultaneously contacting said first substrate and said second substrate with a nickel-free aqueous solution comprising:

(A) phosphate ions,
(B) zinc ions,
(C) cobalt ions,
(D) at least one buffer capable of maintaining the pH of said solution at about 2.8 to about 3.2, and
(E) at least two additional cations other than nickel or those above, present in an amount effective to reduce the redox potential differential of said substrates to less than about 0.35 volts.

* * * * *

UNITED STATES PATENT AND TRADEMARK OFFICE

CERTIFICATE OF CORRECTION

PATENT NO. : 4,717,431

DATED : January 5, 1988

INVENTOR(S) : Knaster et al.

It is certified that error appears in the above-identified patent and that said Letters Patent is hereby corrected as shown below:

In claim 7, at column 18, line 14, "claim" should read --claim 1--.

In claim 17, at column 18, line 40, "tataric" should read --tartaric--.

In claim 30, at column 19, line 13, "coating ." should read --coating--.

Signed and Sealed this

Twelfth Day of September, 1989

*Attest:*

*Attesting Officer*

DONALD J. QUIGG

*Commissioner of Patents and Trademarks*